US009708880B2

(12) United States Patent
Solhaug et al.

(10) Patent No.: US 9,708,880 B2
(45) Date of Patent: Jul. 18, 2017

(54) SWELLABLE PACKER WITH ENHANCED ANCHORING AND/OR SEALING CAPABILITY

(75) Inventors: Kristian Solhaug, Stavanger (NO); Kurtis W. Price, Cypress, TX (US); Ronald L. Hinkie, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 154 days.

(21) Appl. No.: 14/386,089

(22) PCT Filed: Jun. 8, 2012

(86) PCT No.: PCT/US2012/041746

§ 371 (c)(1),
(2), (4) Date: Sep. 18, 2014

(87) PCT Pub. No.: WO2013/184147

PCT Pub. Date: Dec. 12, 2013

(65) Prior Publication Data

US 2015/0075817 A1 Mar. 19, 2015

(51) Int. Cl.

| | |
|---|---|
| ***E21B 33/12*** | (2006.01) |
| ***E21B 23/06*** | (2006.01) |
| ***E21B 33/128*** | (2006.01) |

(52) U.S. Cl.

CPC ..... *E21B 33/128* (2013.01); *E21B 23/06* (2013.01); *E21B 33/1208* (2013.01)

(58) Field of Classification Search

CPC ..... E21B 23/06; E21B 33/12; E21B 33/128; E21B 33/1208

See application file for complete search history.

(56) References Cited

U.S. PATENT DOCUMENTS

| | | | | |
|---|---|---|---|---|
| 3,385,367 | A | 5/1968 | Kollsman | |
| 2007/0151724 | A1* | 7/2007 | Ohmer | E21B 33/1208 166/187 |
| 2007/0205002 | A1 | 9/2007 | Baaijens et al. | |
| 2008/0185158 | A1* | 8/2008 | Chalker | E21B 33/1208 166/387 |
| 2009/0130938 | A1 | 5/2009 | Xu et al. | |

(Continued)

FOREIGN PATENT DOCUMENTS

| | | | |
|---|---|---|---|
| GB | 2458557 | A | 9/2009 |
| WO | 02059452 | A1 | 8/2002 |
| WO | WO-2009027658 | A1 | 3/2009 |

OTHER PUBLICATIONS

International Search Report and Written Opinion issued Jul. 25, 2013 for PCT Patent Application No. PCT/US12/41746, 17 pages.

(Continued)

*Primary Examiner* — Robert E Fuller
*Assistant Examiner* — Christopher Sebesta
(74) *Attorney, Agent, or Firm* — Locke Lord LLP

(57) ABSTRACT

A swellable packer for use with a subterranean well can include a swellable seal having a circumferentially extending recess formed on a surface of the seal. Another swellable packer can include a swellable seal having a helically extending recess formed in the seal. A method of constructing a swellable packer can include forming a circumferentially extending recess on a surface of a swellable seal.

15 Claims, 4 Drawing Sheets

(56) References Cited

U.S. PATENT DOCUMENTS

| | | | | |
|---|---|---|---|---|
| 2009/0200043 | A1* | 8/2009 | Olinger | E21B 33/1208 166/387 |
| 2009/0205817 | A1* | 8/2009 | Gustafson | E21B 33/1208 166/118 |
| 2009/0211770 | A1* | 8/2009 | Nutley | E21B 33/1208 166/387 |
| 2010/0051295 | A1* | 3/2010 | Courville | E21B 19/22 166/387 |
| 2010/0206589 | A1* | 8/2010 | Cornelissen | E21B 33/1208 166/387 |
| 2010/0230094 | A1* | 9/2010 | Foster | E21B 33/1208 166/179 |
| 2010/0288486 | A1 | 11/2010 | Kutac | |

OTHER PUBLICATIONS

Extended European Search Report dated Mar. 3, 2016, issued during the prosecution of corresponding European Patent Application No. 12878361, 7 pages.

* cited by examiner

SWELLABLE PACKER WITH ENHANCED ANCHORING AND/OR SEALING CAPABILITY

CROSS-REFERENCE TO RELATED APPLICATION

This application is a national stage under 35 USC 371 of International Application No. PCT/US12/41746, filed on 8 Jun. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a swellable packer with enhanced anchoring and/or sealing capability.

BACKGROUND

Swellable packers are typically used to seal off annular spaces in wells. Unfortunately, it can take many hours (or even days) for some swellable packers to swell sufficiently, and once swollen, their anchoring and/or differential pressure resisting capabilities may be inadequate. Therefore, it will be appreciated that improvements are continually needed in the art of constructing swellable packers.

SUMMARY

In this disclosure, a swellable packer and associated method are provided which bring improvements to the art of constructing packers. One example is described below in which a fluid channel is formed in a swellable seal of the packer. Another example is described below in which the packer has enhanced swelling and sealing capabilities.

A swellable packer for use with a subterranean well is described below. In one example, the packer can include a swellable seal having a circumferentially extending recess formed on a surface of the seal. In another example, a swellable packer can include a swellable seal having a helically extending recess formed in the seal.

A method of constructing a swellable packer is also described below. In one example, the method can include forming a circumferentially extending recess on a surface of a swellable seal.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
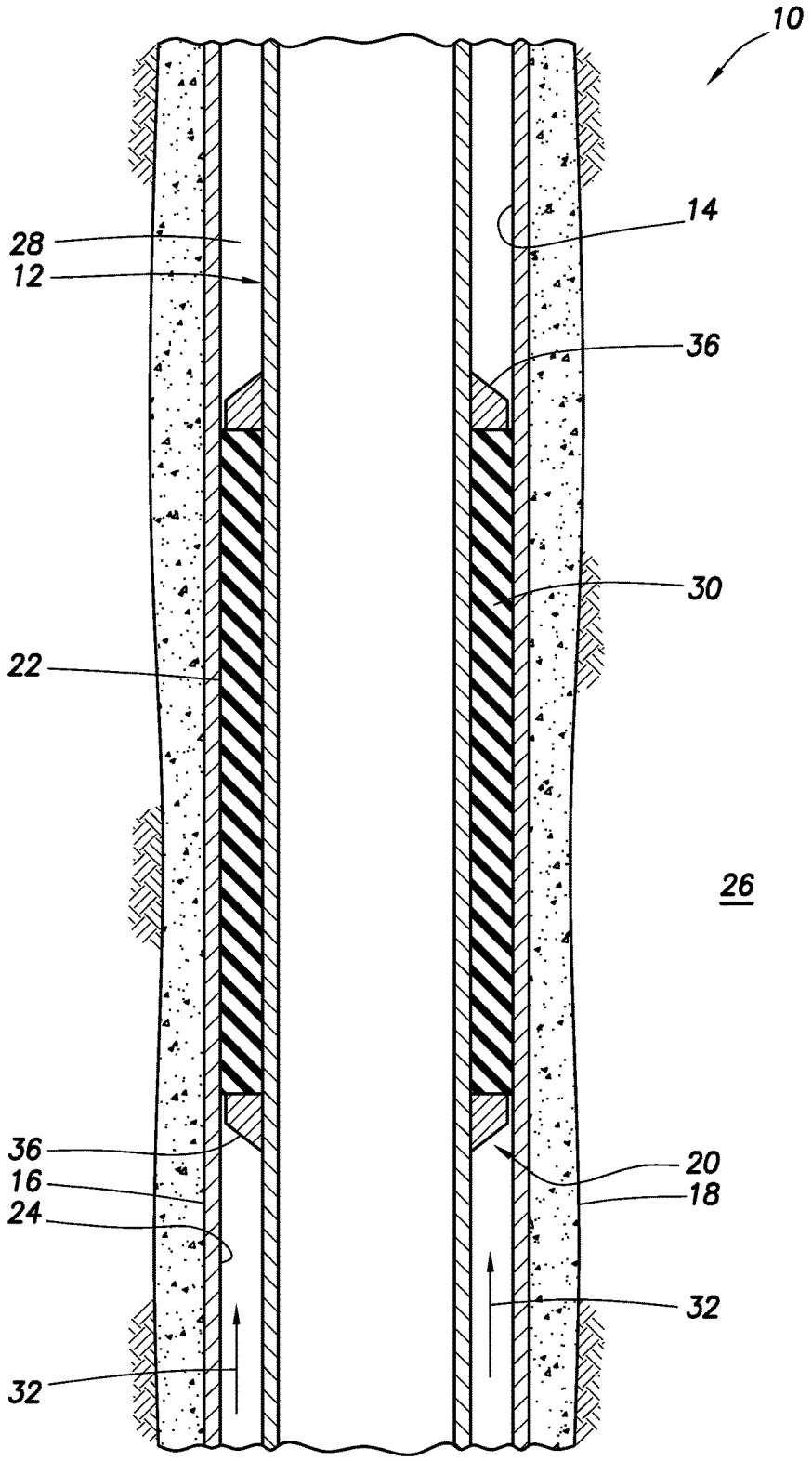
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is installed in a wellbore 14 lined with casing 16 and cement 18. A swellable packer 20 is interconnected in the tubular string 12.

When swollen, as depicted in FIG. 1, a seal 22 of the packer 20 extends radially outward and sealingly engages an inner surface 24 of the wellbore 14. In the FIG. 1 example, the surface 24 is formed in the casing 16, but if the wellbore 14 is uncased or open hole, the surface could be on a wall of a formation 26 penetrated by the wellbore. The seal 22 may seal against any type of well surface in keeping with the scope of this disclosure.

In the FIG. 1 example, sealing contact between the seal 22 and the surface 24 seals off an annulus 28 formed radially between the tubular string 12 and the wellbore 14. Such sealing contact results from contact between a swellable material 30 of the seal 22 and an activating agent in the well.

Preferably, the swellable material 30 swells when it is contacted with a particular activating agent (e.g., oil, gas, other hydrocarbons, water, acid, other chemicals, etc.) in the well. The activating agent may already be present in the well, or it may be introduced after installation of the packer 20 in the well, or it may be carried into the well with the packer, etc. The swellable material 30 could instead swell in response to exposure to a particular temperature, or upon passage of a period of time, or in response to another stimulus, etc.

Thus, it will be appreciated that a wide variety of different ways of swelling the swellable material 30 exist and are known to those skilled in the art. Accordingly, the scope of this disclosure is not limited to any particular manner of swelling the swellable material 30. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 30 is in this example preferably a hydrocarbon fluid (such as oil or gas). In the well system 10, the swellable material 30 swells when a fluid 32 comprises the activating agent (e.g., when the fluid enters the wellbore 14 from the formation 26 surrounding the wellbore, when the fluid is circulated to the packer 20 from the surface, when the fluid is released from a chamber carried with the packer, etc.). In response, the seal 22 seals off the annulus 28 and applies a gripping force to the surface 24.

The activating agent which causes swelling of the swellable material 30 could be comprised in any type of fluid. The activating agent could be naturally present in the well, or it could be conveyed with the packer 20, conveyed separately or flowed into contact with the swellable material 30 in the well when desired. Any manner of contacting the activating agent with the swellable material 30 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 30 may have a substantial portion of cavities therein which are compressed or collapsed at the surface condition. Then, after being placed in the well at a higher pressure, the material 30 is expanded by the cavities filling with fluid.

This type of apparatus and method might be used where it is desired to expand the swellable material 30 in the presence of gas rather than oil or water. A suitable swellable material is described in U.S. Published Application No. 2007-0257405, the entire disclosure of which is incorporated herein by this reference.

Preferably, the swellable material 30 used in the seal 22 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 30 could also swell in response to contact with any of multiple activating agents. For example, the swellable material 30 could swell when contacted by hydrocarbon fluid, or when contacted by water.

Figure 2:
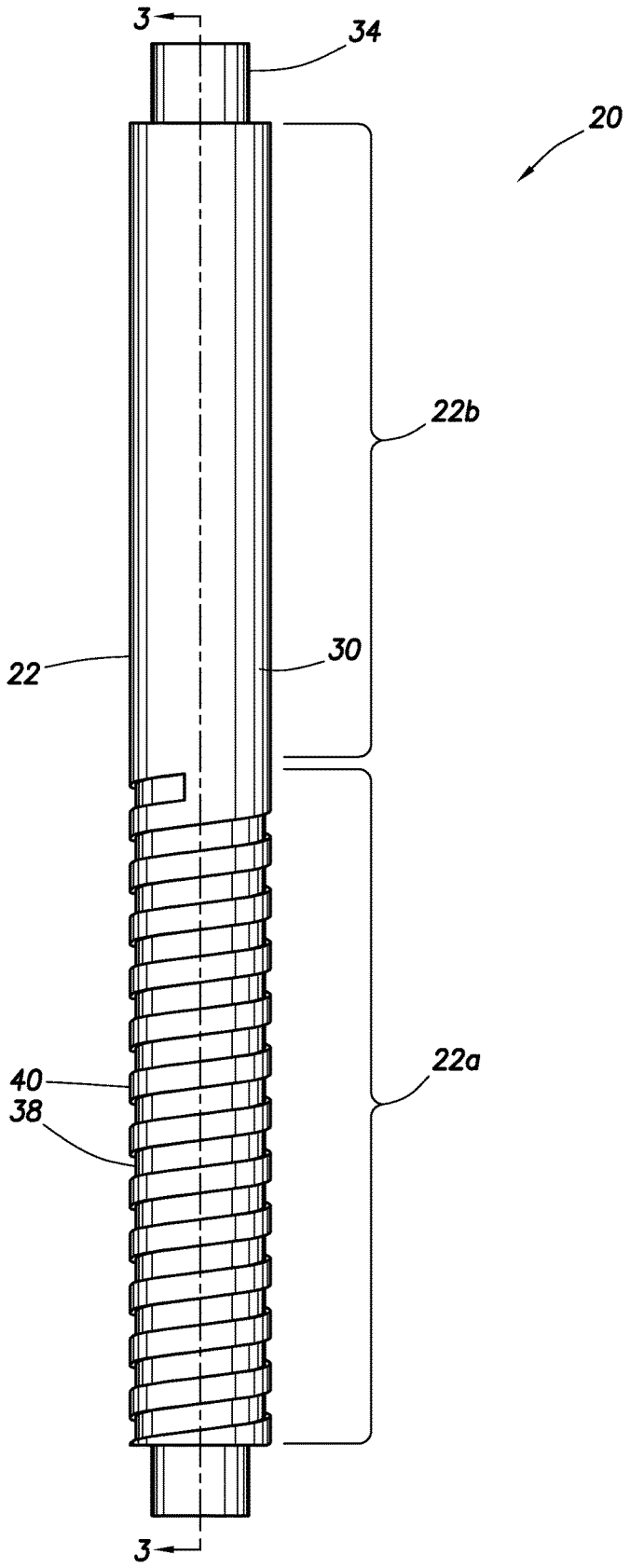
FIG. 2 is a representative side view of a swellable packer which may be used in the system and method of FIG. 1, and which can embody principles of this disclosure.
Figure 3:
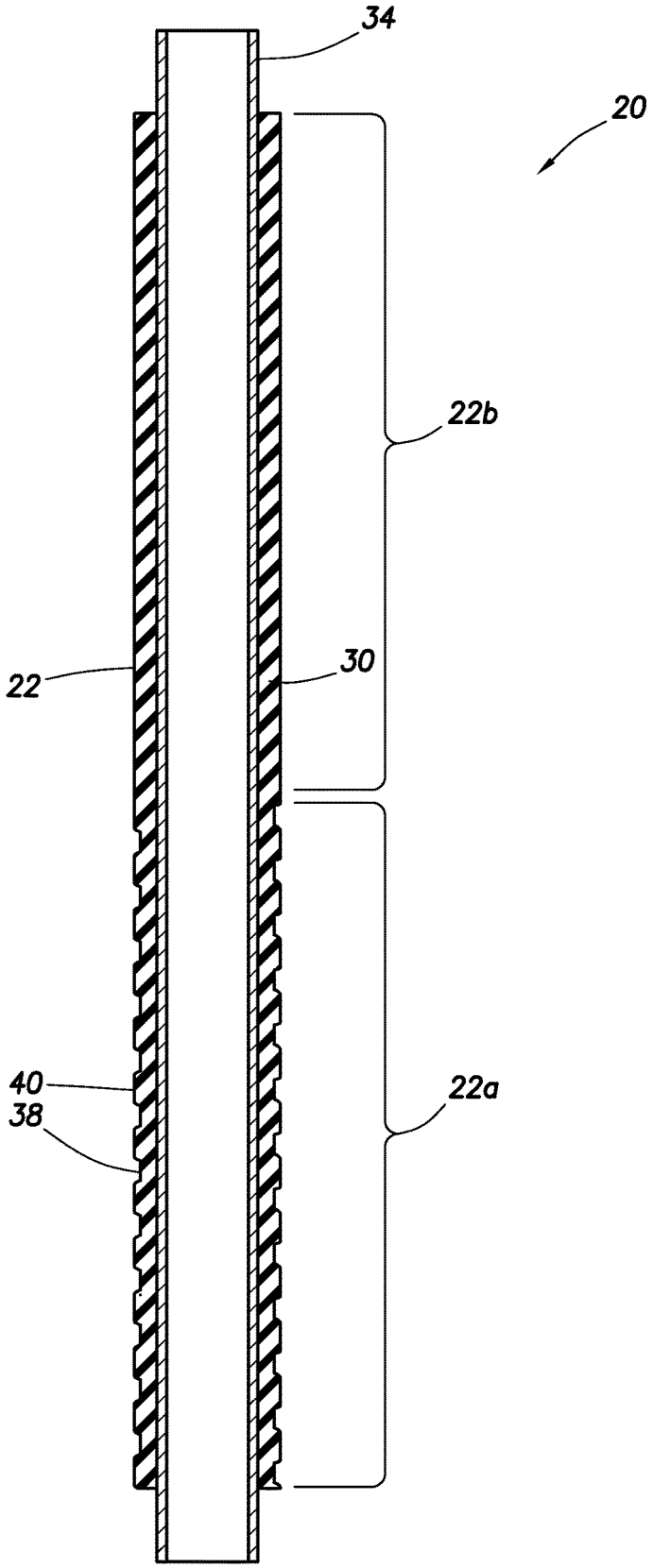
FIG. 3 is a representative cross-sectional view of the packer, taken along line 3-3 of FIG. 2.

Referring additionally now to FIGS. 2 & 3, respective side and cross-sectional views of one example of the swellable packer 20 are representatively illustrated. The packer 20 may be used in the system 10 and method described above, or the packer may be used in other systems and methods.

In the FIGS. 2 & 3 example, the swellable seal 22 extends circumferentially about a generally tubular base pipe 34. The base pipe 34 may be provided with end connectors (e.g., threaded connections, etc.) for interconnecting the packer 20 in the tubular string 12.

The seal 22 may be affixed to the base pipe 34 using any of a variety of different techniques. For example, the seal 22 could be separately formed and then bonded to the base pipe 34, the seal could be molded onto the base pipe, the seal could be wrapped about the base pipe, the seal could have a longitudinal slit through which the base pipe is laterally passed, and/or end rings 36 (not shown in FIG. 2, see FIG. 1) could longitudinally retain the seal on the base pipe, etc.

A longitudinal portion 22*a* of the seal 22 has a recess 38 formed on an outer surface 40 thereof. The recess 38 in this example extends circumferentially about the seal 22, and longitudinally along the seal, thereby providing a helical conduit for flow of the fluid 32 along the outer surface 40, and increasing a surface area of the swellable material 30 exposed to the fluid.

By distributing the fluid 32 (comprising the activating agent) circumferentially and longitudinally along the seal 22, thereby exposing more of the swellable material 30 to the fluid, the seal 22 will more quickly swell into sealing contact with the well surface 24, and a differential pressure resisting capability of the packer 20 will be increased due to a greater volume of the swellable material having been swollen. In addition, the presence of the circumferentially extending recess 38 can provide for increased gripping force being applied between the surfaces 24, 40 when the seal 22 has swollen radially outward.

In the example of FIGS. 2 & 3, the recess 38 is formed on a lower portion 22*a* of the seal, and an upper portion 22*b* of the seal 22 does not have the recess formed thereon. However, in other examples, the recess 38 could be formed on the entire seal 22, or it could be formed on the upper portion 22*b* of the seal, in which case the lower portion 22*a* may not have the recess formed thereon.

Although a single helically extending recess 38 is depicted in FIG. 2 on an outer surface 40 of the seal 22, it will be appreciated that the recess could be otherwise formed to enhance swelling of the material 30 and/or to increase an anchoring capability of the packer 20. For example, the recess 38 could be formed in an inner surface of the seal 22, the recess could extend circumferentially without also extending longitudinally, multiple recesses could be used, etc. Thus, it should be clearly understood that the scope of this disclosure is not limited to any of the details of the packer 20 described herein or depicted in the drawings.

Figure 4:
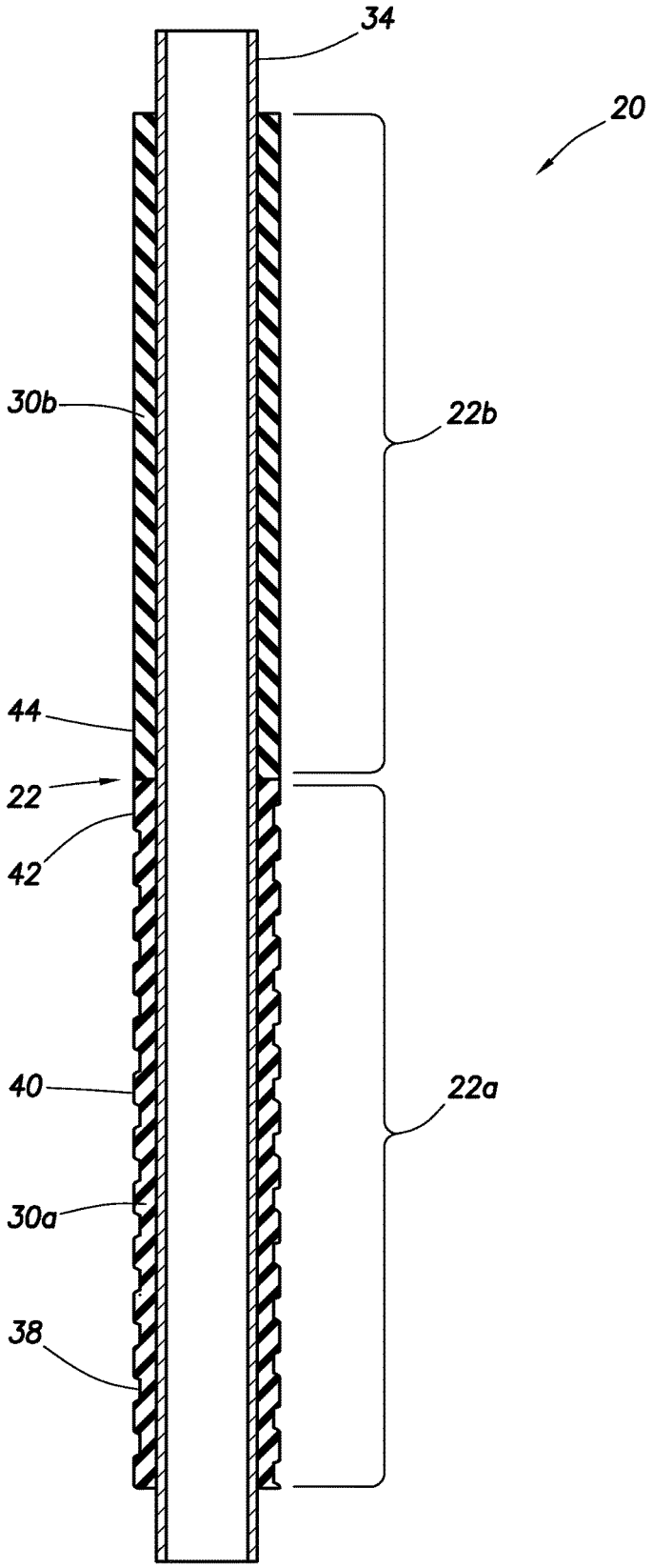
FIG. 4 is a representative side view of another example of the packer.

Referring additionally now to FIG. 4, another example of the swellable packer 20 is representatively illustrated. In this example, the seal 22 comprises multiple seal elements 42, 44 on the base pipe 34. Although only two seal elements 42, 44 are depicted in FIG. 4, it will be appreciated that any number of seal elements may be used, as desired.

In the FIG. 4 example, the seal element 42 has the recess 38 formed on its outer surface 40, and the seal element 44 does not have the recess formed thereon. In addition, the seal element 42 comprises a different swellable material 30*a* from a swellable material 30*b* of the seal element 44. In other examples, the swellable materials 30*a,b* could be the same swellable materials.

One potential benefit of using different materials is that the different materials can be individually selected to provide particular enhanced properties to the overall seal 22 assembly. For example, the swellable material 30*a* could be selected for its capability to swell quickly (or at least at a faster rate than the material 30*b*) or in response to contact with a particular activating agent, whereas the swellable material 30*b* could be selected for its capability to swell in response to contact with another activating agent, or for its long term durability, enhanced anchoring capability, differential pressure resisting capability, etc. Of course, the materials 30*a,b* may be selected for other purposes, and may be used in other combinations, within the scope of this disclosure.

It may now be fully appreciated that the above disclosure provides significant benefits to the art of constructing swellable packers. Examples of the swellable packer 20 described above have enhanced sealing and anchoring capabilities, due at least in part to the recess 38 which distributes the fluid 32 around the surface 40 of the seal 22, so that more of the swellable material 30 is exposed to the fluid.

The above disclosure provides to the art a swellable packer 20 for use with a subterranean well. In one example, the packer 20 can include a swellable seal 22 having a circumferentially extending recess 38 formed on a surface 40 of the seal 22.

The recess 38 may also extend longitudinally on the seal surface 40.

The surface 40 may be an outer surface of the seal 22. In other examples, the surface 40 could be an inner, end, or other surface of the seal 22.

The surface 40 may sealingly contact a well surface 24 when the seal 22 swells.

The swellable seal 22 can extend circumferentially about a base pipe 34 interconnected in a tubular string 12.

The seal 22 may comprise multiple seal elements 42, 44 having different swelling rates, and/or different differential pressure resisting capabilities. The recess 38 may be formed on less than all of the seal elements 42, 44.

The recess 38 may not be formed on a longitudinal portion 22*b* of the seal 22.

The seal 22 may swell in response to contact with an activating agent in the well.

Another swellable packer 20 example is described above. The swellable packer 20 comprises a swellable seal 22 having a helically extending recess 38 formed in the seal 22.

A method of constructing a swellable packer 20 is also described above. In one example, the method comprises forming a circumferentially extending recess 38 on a surface 40 of a swellable seal 22.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A swellable packer for use with a subterranean well, the packer comprising:

a swellable seal having an annular thickness and defining a longitudinal axis and a radial direction relative thereto, wherein the swellable seal includes a helically extending recess formed on a surface of the seal, wherein a radially facing surface of the helically extending recess is delimited by a radially facing surface of the seal, the helically extending recess having a channel depth less than the annular thickness of the swellable seal itself, wherein the helically extending recess is kept free for flow of fluid therethrough prior to expansion of the swellable seal.

2. The packer of claim 1, wherein the surface comprises an outer surface of the seal.

3. The packer of claim 1, wherein the surface sealingly contacts a well surface when the seal swells.

4. The packer of claim 1, wherein the swellable seal extends circumferentially about a base pipe interconnected in a tubular string.

5. The packer of claim 1, wherein the seal comprises multiple seal elements having different swelling rates.

6. The packer of claim 1, wherein the seal comprises multiple seal elements having different differential pressure resisting capabilities.

7. The packer of claim 1, wherein the seal comprises multiple seal elements, the recess being formed on less than all of the seal elements.

8. A method of constructing a swellable packer, the method comprising:

forming a helically extending recess on a surface of a swellable seal having an annular thickness, wherein the swellable seal defines a longitudinal axis and a radial direction relative thereto, wherein a radially facing surface of the helically extending recess is delimited by a radially facing surface of the seal, the helically extending recess having a channel depth less than the annular thickness of the seal itself, wherein the helically extending recess is kept free for flow of fluid therethrough prior to expansion of the swellable seal.

9. The method of claim 8, wherein the surface comprises an outer surface of the seal.

10. The method of claim 8, further comprising the surface sealingly contacting a well surface in response to swelling of the seal.

11. The method of claim 8, wherein the swellable seal extends circumferentially about a base pipe, and further comprising interconnecting the base pipe in a tubular string.

12. The method of claim 8, wherein the seal comprises multiple seal elements having different swelling rates.

13. The method of claim 8, wherein the seal comprises multiple seal elements having different differential pressure resisting capabilities.

14. The method of claim 8, wherein the seal comprises multiple seal elements, the recess being formed on less than all of the seal elements.

15. The method of claim 8, further comprising the seal swelling in response to contact with an activating agent in the well.

* * * * *